US007914291B2

(12) United States Patent
Rashkover

(10) Patent No.: US 7,914,291 B2
(45) **Date of Patent: *Mar. 29, 2011**

(54) ELECTRICAL HOSE SWIVEL CONNECTOR

(76) Inventor: Irwin Rashkover, Brentwood, TN (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/471,930

(22) Filed: May 26, 2009

(65) Prior Publication Data

US 2009/0246977 A1 Oct. 1, 2009

Related U.S. Application Data

(63) Continuation of application No. 11/866,838, filed on Oct. 3, 2007, now Pat. No. 7,537,457.

(60) Provisional application No. 60/848,977, filed on Oct. 3, 2006.

(51) Int. Cl.
*H01R 39/00* (2006.01)

(52) U.S. Cl. ..... 439/13

(58) Field of Classification Search ..... 439/13, 439/21, 23; 30/201, 133, 233.5, 210, 216; 15/377

See application file for complete search history.

(56) References Cited

U.S. PATENT DOCUMENTS

| | | | |
|---|---|---|---|
| 4,063,790 | A | 12/1977 | Kleykamp et al. |
| 4,283,594 | A | 8/1981 | Somers |
| 4,473,923 | A | 10/1984 | Neroni et al. |
| 4,547,029 | A | 10/1985 | Kutnyak et al. |
| 4,550,957 | A | 11/1985 | Keane |
| 4,550,958 | A | 11/1985 | Smith |
| 4,557,535 | A | 12/1985 | Keane |
| 4,634,197 | A | 1/1987 | Horlacher, Jr. |
| 4,787,117 | A | 11/1988 | Westergren |
| 5,755,578 | A | 5/1998 | Contant et al. |
| 7,226,302 | B2 | 6/2007 | Walter et al. |

*Primary Examiner* — Briggitte R Hammond
(74) *Attorney, Agent, or Firm* — Dickinson Wright PLLC

(57) ABSTRACT

An electrical hose swivel connector may be used to connect a vacuum hose to a hair clipping device. The hair clipping device may need power, which may be delivered from a power source and through a power cord. The power cord may be in electrical communication with this electrical hose swivel connector to deliver power to the hair clipping device. This electrical hose swivel connector can allow for easier use of the hair clipping device, which may be used with the vacuum hose without causing tangling, twisting, or knotting in the power cord.

2 Claims, 2 Drawing Sheets

ELECTRICAL HOSE SWIVEL CONNECTOR

The present application claims priority benefit of U.S. Provisional Patent Application No. 60/848,977 filed Oct. 3, 2006 which is incorporated herein by reference in its entirety.

TECHNICAL FIELD

This invention relates to hair clipping devices having vacuum hoses and, more particularly, to a swivel connector for connecting a vacuum hose between a vacuum device and a hair clipper.

BACKGROUND OF THE INVENTION

Prior art hair clipping devices are commonly connected to a vacuum hose in addition to a required power source. Such prior art hair clipping devices are characterized by having a separate vacuum hose and a separate power cord which connects the clipper to the electrical power source. The usage of such hair clippers, particularly when being used to groom pets, requires constant motion and direction changes. As such, it is not uncommon in such systems for the vacuum hose and the power cord to frequently and undesirably twist and knot together making use of the clippers difficult and inefficient.

BRIEF DESCRIPTION OF THE DRAWINGS

The accompanying drawings, which are incorporated in and constitute a part of this specification, illustrate embodiments of the invention, and, together with the general description of the invention given above, and the detailed description of the embodiments given below, serve to explain the principles of the present invention, where.

DETAILED DESCRIPTION OF THE INVENTION

Figure 1:
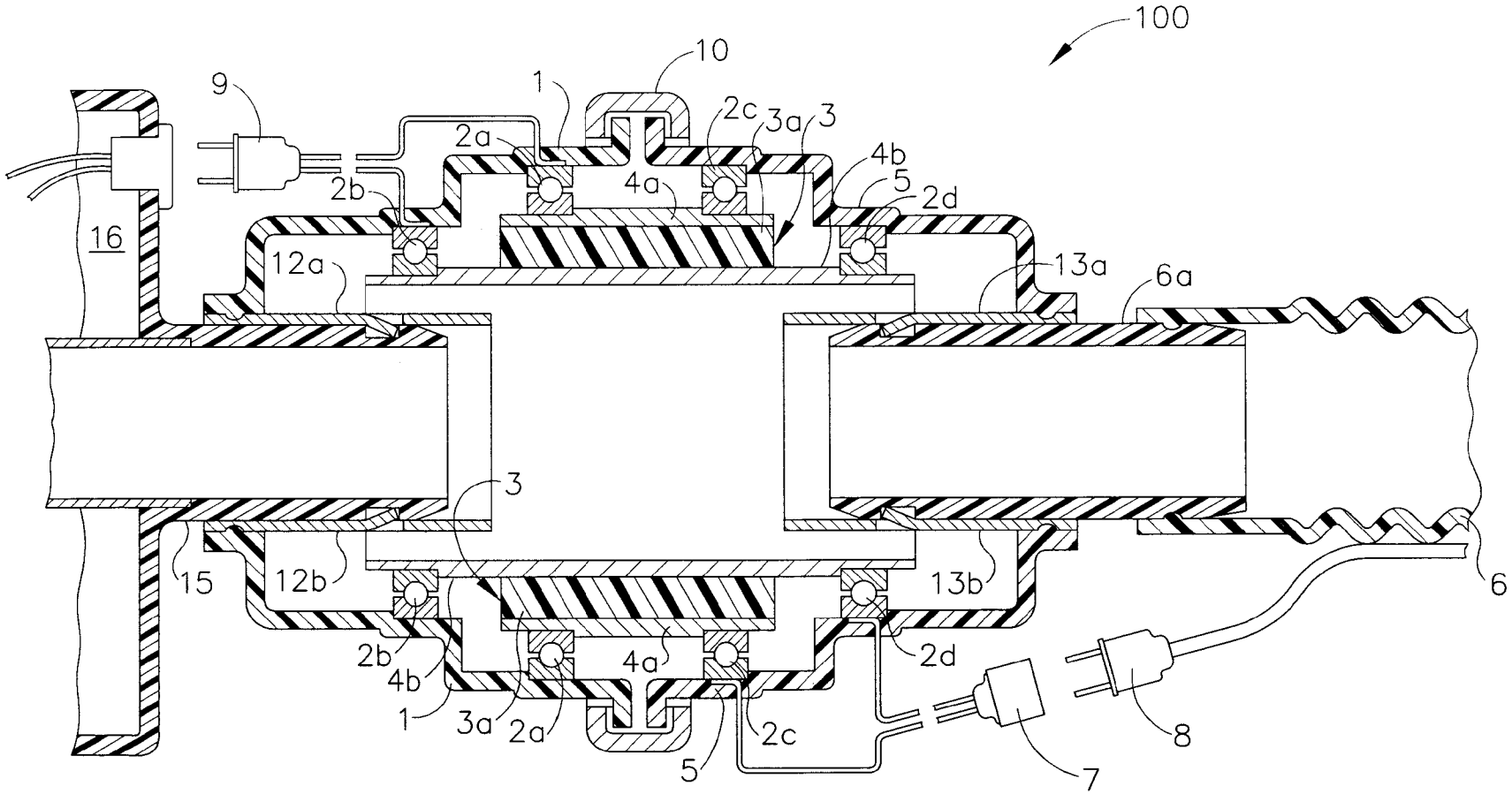
FIG. 1 is a schematic view of one embodiment of the present invention encompassing a non-twist linear contacts adapter.

Referring now to FIG. 1, a non-twist linear contacts electrical hose swivel connector 100 is shown. The connector 100 generally comprises a first power transfer coupling 1, a connector body 3, and a second power transfer coupling 5. The first power transfer coupling 1 preferably comprises a body which encompasses a first metallic ring 2*a* and a second metallic ring 2*b*. Each ring 2*a*, 2*b* may be rigidly secured within the body of the first coupling 1 by way of a snap-fit between the ring and a corresponding groove within the body of the coupling 1, an adhesive, or any suitable means as known in the art. Also, the first power transfer coupling 1 preferably includes an electrical connector 9 for providing electrical communication between the rings 2*a*, 2*b* and the clipper 16. The second power transfer coupling 5 preferably comprises a body which encompasses a first metallic ring 2*c* and a second metallic ring 2*d*. Each ring 2*c*, 2*d* may be rigidly secured within the body of the second coupling 5 by way of a snap-fit between the ring and a corresponding groove within the body of the coupling 5, an adhesive, or any suitable means known in the art. Also, the second power transfer coupling 5 preferably includes an electrical connector 7 for providing electrical communication between a corresponding electrical connector 8 of a vacuum hose and the rings 2*c*, 2*d*. The bodies of each power transfer coupling 1, 5 are preferably comprised of a resilient, electrical insulating material, such as PVC, neoprene, or the like.

The connector body 3 preferably includes a first metallic tube 4*a* electrically insulated from a second metallic tube 4*b* by an insulating body 3*a*. The insulating body 3*a* is preferably comprised of a resilient, electrical insulating material, such as PVC, neoprene, Styrofoam®, or the like. A first set of tabs 12*a* and 12*b* may extend from within a first end of the second metallic tube 4*b* and a second set of tabs 13*a* and 13*b* may extend from within a second end of the second metallic tube 4*b*. The first set of tabs 12*a* and 12*b* may be configured to engage at least a portion of the interior of the first power transfer coupling 1 such that the first power transfer coupling 1 and connector body 3 are rigidly secured to one another. Likewise, the second set of tabs 13*a* and 13*b* may be configured to engage at least a portion of the interior of the second power transfer coupling 5 such that the second power transfer coupling 5 and connector body 3 are rigidly secured to one another. The tabs 12*a,b* and 13*a,b* and corresponding power transfer couplings 1, 5 may be rigidly secured to one another via a friction fit, a snap-fit between tabs and corresponding slots, an adhesive, or the like. Additionally, the first set of tabs 12*a* and 12*b* may be configured to releasably engage a molded nipple 15 of a clipper 16. Also, the second set of tabs 13*a* and 13*b* may be configured to releasably engage a vacuum hose or an adapter 6 therebetween.

The first power transfer coupling 1 is placed about a first end of the connector body 3 such that the first set of tabs 12*a* and 12*b* engage the interior of the first power transfer coupling 1 and such that the first metallic tube 4*a* is in electrical communication with the first ring 2*a* and the second metallic tube 4*b* is in electrical communication with the second ring 2*b*. Similarly, the second power transfer coupling 5 is placed about a second end of the connector body 3 such that the second set of tabs 13*a* and 12 *b* engage the interior of the second power transfer coupling 5 and such that the first metallic tube 4*a* is in electrical communication with the first ring 2*c* and the second metallic tube 4*b* is in electrical communication with the second ring 2*d*. Preferably, the rings 2*a-d* and metallic tubes 4*a*, 4*b* are arranged such that each ring 2*a-d* is free to rotate about the surface of a corresponding metallic tube 4*a*, 4*b*.

The vacuum hose 6 is preferably connected to the second power transfer coupling 5 via a hose coupler 6*a*. Alternatively, the second set of tabs 13*a,b* may be configured to engage the vacuum hose directly such that the second power transfer coupling 5 and vacuum hose are rigidly secured to one another; for example, the coupler 6*a* may be an integral part of the tabs 13*a,b*. The clipper 16 is secured to the first power transfer coupling 1 by engaging the first set of tabs 12*a,b* with the nipple 15 of the clipper 16 such that the first coupling 1 rotates along with rotation of the clipper 16 while the second power transfer coupling 5 remains stationary relative to rotation of the first coupling 1 and clipper 16. Also, a loose fitting snap collar 10 may be used to further rotatably secure the first and second power transfer couplings 1,5 together. The electrical connector 9 of the first coupling 1 is electrically connected to the clipper and the electrical connector 7 of the second coupling 2 is electrically connected to electrical connector 8 of the vacuum hose such that power may be transferred from a power source through the electrical connector 8 of the vacuum hose and adapter 100 to the clipper. It should be apparent that this configuration advantageously allows for clipper use without entanglement and kinking of a hose and electrical cord as is associated with prior art devices.

Figure 2:
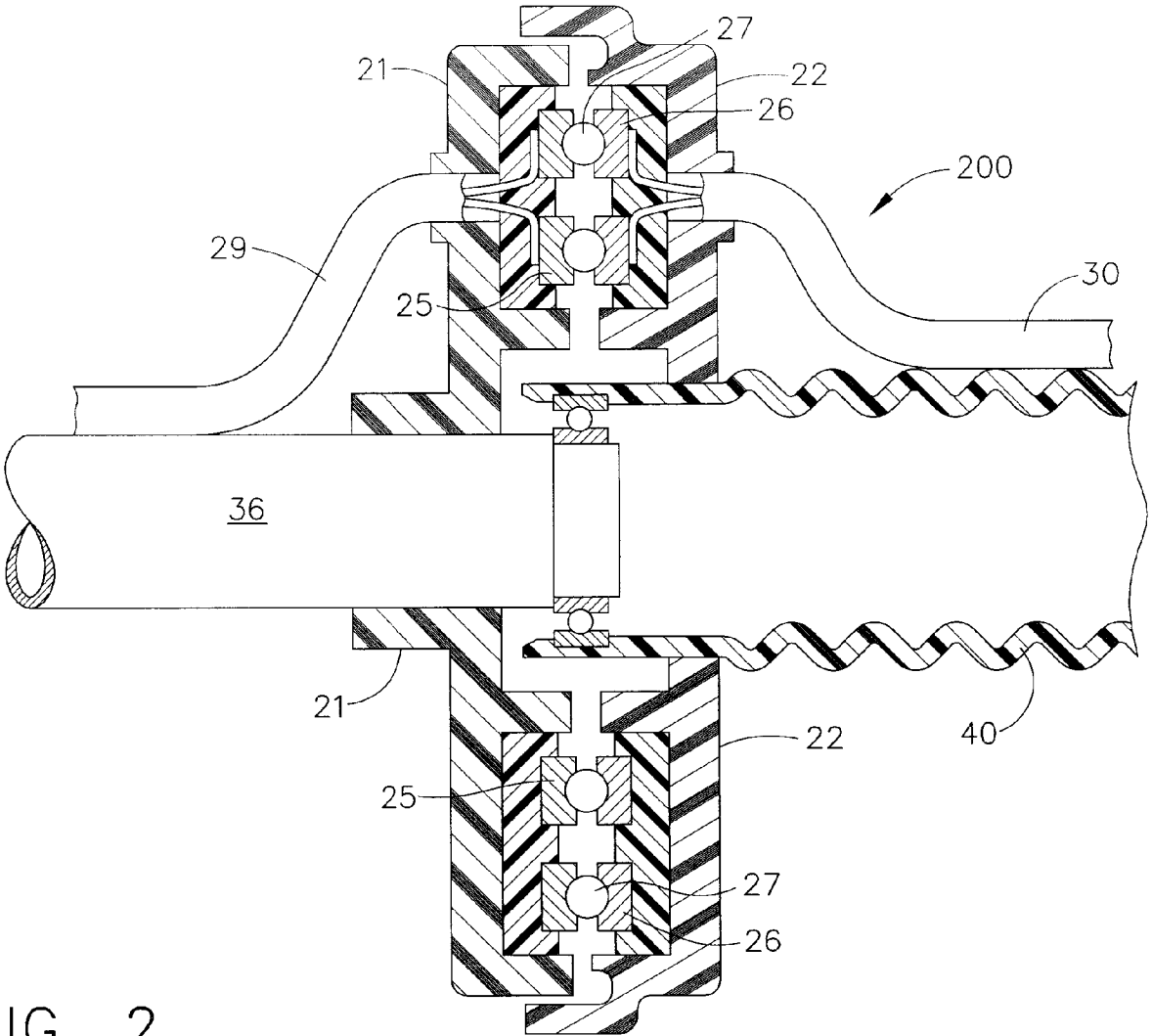
FIG. 2 is a schematic view of another embodiment of the present invention encompassing a non-twist flat plates adapter.

Referring now to FIG. 2, an additional embodiment of the present invention is shown encompassing a non-twist flat plates electrical hose swivel connector 200. The adapter 200 generally comprises two interlocking cups 21, 22. Each cup 21, 22 preferably includes a central opening therethrough. In addition, the cups 21, 22 are configured to lockingly engage one another such that the central openings are aligned and such that each cup 21, 22 is free to rotate relative to the other cup 21, 22. For example, as shown in FIG. 2, the diameter of the first cup 21 may be smaller than the diameter of the second cup 22 such that the first cup 21 rests within the second cup 22. The cups 21, 22 are preferably comprised of a resilient, electrical insulating material, such as PVC, neoprene, or the like.

Also, the first cup 21 preferably includes an electrical connector 29 for providing electrical communication between one or more metallic disks 25 and the clipper 36. One or more additional metallic disks 26 may be provided and the second cup 22 preferably includes an electrical connector 30 for providing electrical communication between the disks 26 and a corresponding electrical connector of a vacuum hose 40.

A plurality of metallic ball bearings 27 are held between disks 25, 26 serve as transfer contacts between the metallic disks 25, 26 such that power may be transferred from a power source through the electrical connector of the vacuum hose and adapter 200 to the clipper.

A nipple 32 of a clipper slidingly engages the central opening of tile first cup 21 and a vacuum hose 33 slidingly engages the central opening of the second cup 22 such that the nipple 32 of the clipper and the vacuum hose 33 may be releasably secured to one another as is known in the art and such that the second cup 22 rotates along with rotation of the hose 33 while the first cup 21 remains stationary relative to rotation of the second cup 22 and hose 33.

While the present invention has been illustrated by the description of several embodiments and while the illustrative embodiments have been described in considerable detail, it is not the intention of the applicant to restrict or in any way limit the scope of the invention to such detail. Additional advantages and modifications may readily appear to those skilled in the art.

The invention claimed is:

1. A rotatable electrical connection comprising:

a) a first power transfer coupling comprising a body encompassing first and second conductive rings and an electrical connector for providing electrical connection between said rings;

b) a connector body including first and second conductive tubes;

c) a second power transfer coupling comprising a body encompassing first and second conductive rings and an electrical connector for providing electrical connection between said rings d) said first power transfer coupling placed about a first end of said connector body such that the first conductive tube is in electrical communication with the corresponding first ring of said first coupling and the second conductive tube is in electrical communication with said corresponding second ring of said first coupling;

e) said second power transfer coupling placed about a second end of said connector body such that said first conductive tube is in electrical communication with said corresponding first ring of said second coupling and said second conductive tube is in electrical communication with said second ring of said second coupling in a manner such that each ring is free to rotate about a surface of a corresponding conductive tube and such that said first power transfer coupling and said second power transfer coupling can freely rotate relative to each other.

2. A rotatable electrical connector comprising:

a) a first cup including a first and a second metallic disc each of said discs connected to an electrical connector;

b) a second cup including a first and a second metallic disc each of said discs connected to an electrical connector, said first and said second cups lockably engaged to each other such that each of said cups can freely rotate relative to the other of said cups and such that said first and said second metallic discs of said first cup are aligned with said first and said second metallic discs of said second cup, respectively; and c) a first plurality of metallic ball bearings held between said first discs and a second plurality of metallic ball bearings held between said second discs, said first and said second plurality of ball bearings serving as electrical charge transfer contacts between said first discs and between said second discs such that electrical power can be transferred between said first and said second cups.

* * * * *